US005648044A

United States Patent [19]

Hoshino et al.

[11] Patent Number: 5,648,044

[45] Date of Patent: Jul. 15, 1997

[54] GRAPHITE STEEL FOR MACHINE STRUCTURAL USE EXHIBITING EXCELLENT FREE CUTTING CHARACTERISTIC, COLD FORGING CHARACTERISTIC AND POST-HARDENING/TEMPERING FATIGUE RESISTANCE

[75] Inventors: Toshiyuki Hoshino; Takashi Iwamoto; Akihiro Matsuzaki; Keniti Amano, all of Okayama, Japan

[73] Assignee: Kawasaki Steel Corporation, Kobe, Japan

[21] Appl. No.: 446,488

[22] Filed: May 22, 1995

Related U.S. Application Data

[62] Division of Ser. No. 283,800, Aug. 1, 1994, Pat. No. 5,476,556.

[30] Foreign Application Priority Data

Aug. 2, 1993 [JP] Japan ..... 191398

[51] Int. Cl.[6] ..... C22C 38/02; C22C 38/04

[52] U.S. Cl. ..... 420/99; 420/121; 420/128; 148/328; 148/330

[58] Field of Search ..... 420/99, 128, 121; 148/330, 328

[56] References Cited

U.S. PATENT DOCUMENTS 5,454,887 10/1995 Fukui ..... 148/603

*Primary Examiner*—Deborah Yee
*Attorney, Agent, or Firm*—Dvorak and Traub

[57] ABSTRACT

Graphite steel for a machine structural use exhibiting excellent cutting characteristic, cold forging characteristic and fatigue resistance, the graphite steel for a machine structural use containing: C: 0.1 wt % to 1.5 wt %; Si: 0.5 wt % to 2.0 wt %; Mn: 0.1 wt % to 2.0 wt %; B: 0.0003 wt % to 0.0150 wt %; Al: 0.005 wt % to 0.1 wt %; O≦0.0030 wt %; P≦0.020 wt %; S≦0.035 wt %; N: 0.0015 wt % to 0.0150 wt %; and a balance consisting of Fe and unavoidable impurities, wherein substantially overall quantity of C is precipitated as graphite and size of graphite is 20 μm or less.

8 Claims, No Drawings

GRAPHITE STEEL FOR MACHINE STRUCTURAL USE EXHIBITING EXCELLENT FREE CUTTING CHARACTERISTIC, COLD FORGING CHARACTERISTIC AND POST-HARDENING/TEMPERING FATIGUE RESISTANCE

This is a divisional of application Ser. No. 08/283,800 filed on Aug. 1, 1994, now U.S. Pat. No. 5,476,556.

BACKGROUND OF THE INVENTION

1. Field of the Invention

The present invention relates to steel for a machine structural use, the free cutting characteristic, the cold forging characteristic and post-hardening/tempering fatigue resistance of which are simultaneously improved, and which therefore is used to advantage as a material for production of machine parts for use in automobiles or the like.

2. Description of the prior Art

Steel used to manufacture machine parts of industrial machines, automobiles and so forth must have a satisfactory cutting characteristic, a cold forging characteristic and a mechanical characteristic to be realized after it has been hardened and tempered, and more particularly the steel must have good fatigue resistance.

The cutting characteristic of steel is usually improved by a method in which one or more elements, such as Pb, S, Te, Bi and P, are added to the steel. Among the foregoing elements, Pb is widely used because of its significant effect of improving the cutting characteristic. However, since some elements are harmful for the human body, an exhausting facility having great size must be used in the process of manufacturing the steel. In addition, there arise a multiplicity of critical problems in recycling the steel. On the other hand, the foregoing elements obstruct the improvement in the cold forging characteristic of the steel.

As described above, the free cutting characteristic and the cold forging characteristic are usually contradictory to each other. However, the steel for a machine structural use must simultaneously have the foregoing two characteristics. In order to satisfy the foregoing requirement, graphite steel has been suggested as disclosed in Japanese Patent Laid-Open No. 51-57621, Japanese Patent Laid-Open No. 49-103817, Japanese Patent Laid-Open No. 03-140411 and Japanese Patent Laid-Open No. 03-146618.

However, inventors of the present invention have investigated the foregoing methods and found a fact that the methods cannot satisfactorily realize the characteristics required for the steel for a machine structural use. In particular, the methods cannot satisfactorily realize desired fatigue resistance.

For example, the method disclosed in Japanese Patent Laid-Open No. 51-57621 encounters a limit to refining of graphite particles, e.g., to 45 to 70 μm, because only Si, Al, Ti and rare earth elements are used as elements for enhancing graphite forming. In this case, solution of graphite does not proceed quickly at the time of heating preceding quenching of the steel, thus resulting in that the obtainable fatigue resistance is unsatisfactory. The method disclosed in Japanese Patent Laid-Open No. 49-103817 does not give any specific consideration to Cr and N contents, so that the steel shown therein requires a long time for graphitization. In addition, the graphite particles are rather coarse, 38 to 50 μm, hampering fatigue strength after hardening/tempering. Therefore, the process takes an excessively long time to be completed. Since the graphite forming process takes a long time, fining of graphite particles is limited. Thus, solution of graphite does not proceed quickly at the time of heating preceding quenching of the steel, and accordingly the obtainable fatigue resistance is limited. The method disclosed in Japanese Patent Laid-Open No. 03-140411 does not pay specific attention to conditions which significantly affect graphitization, e.g., hot rolling condition and graphitization annealing. Consequently, graphitization time is impractically long and graphite grain size cannot be reduced down below 28 to 35 μm, thus reducing post-hardening/tempering fatigue strength. The method disclosed in Japanese Patent Laid-Open No. 03-146618 employs inadequate annealing conditions, so that the graphite grain size is as large as 21 to 26 μm, failing to provide satisfaction to the demand for improvement in post-hardening/tempering fatigue strength. Thus, all these known techniques are still unsatisfactory in that they could only provide fatigue strength of 430 MPa and durability ratio of 1.2 or so at the greatest when hardened/tempered as machine part, due to coarse grain structure.

SUMMARY OF THE INVENTION

Accordingly, an object of the present invention is to overcome the foregoing problems experienced with the conventional technology, and more particularly to overcome the problem experienced with graphite steel and therefore an object of the present invention is to provide steel for a machine structural use that has the free cutting characteristic equivalent or superior to that of conventional Pb-added free cutting steel while maintaining the cold forging characteristic and as well as exhibiting excellent post-hardening/tempering fatigue resistance.

According to one aspect of the present invention, there is provided graphite steel for a machine structural use exhibiting excellent cutting characteristic, cold forging characteristic and fatigue resistance, the graphite steel for a machine structural use comprising:

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %; and a balance consisting of Fe and unavoidable impurities, wherein substantially overall quantity of C is precipitated as graphite and size of graphite is 20 μm or less.

According to another aspect of the present invention, there is provided a method of manufacturing steel for a machine structural use exhibiting excellent cutting characteristic, cold forging characteristic and fatigue resistance, the method of manufacturing steel for a machine structural use comprising the steps of:

selecting steel composed by

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %;

and a balance consisting of Fe and unavoidable impurities;

heating said steel to a temperature level higher than solid-solution temperature for BN and that for AlN;

hot rolling the steel;

heating the steel to a temperature region from 300° C. to 600° C.;

maintaining the steel at the temperature region for 15 minutes or longer;

heating the steel to a temperature region from 680° C. to 740° C.; and maintaining the steel at the temperature region for 5 hours or longer so that substantially overall quantity of C is precipitated as graphite.

Other and further objects, features and advantages of the invention will be appear more fully from the following description.

DESCRIPTION OF THE PREFERRED EMBODIMENTS

The inventors of the present invention have investigated an influence of the size of graphite particles upon the cutting characteristic and the cold forging characteristic. As a result, it was discovered that fining of graphite particles improves the cutting characteristic and the cold forging characteristic.

Although the mechanism for improving the two characteristics has not been clarified yet, the following consideration can be made.

As for the cutting characteristic, presence of graphite in the steel causes great distortion to act in a shearing region at the time of the cutting process, thus resulting in generation of voids in the boundary between the graphite and the maternal phase. The generated voids are connected and thus chip is generated. Since the volume ratio is constant if the quantity of carbon is the same, the finer the graphite is, the easier the connection of the voids proceeds. As a result, the cutting characteristic can be improved.

As for the cold forging characteristic, fining of the particle size of graphite and enlarging the quantity of limit distortion of voids generated in the boundary between the graphite and the maternal phase is considered to improve the cold forging characteristic. As for the influence of graphite upon the fatigue resistance, the following result was obtained: the fatigue resistance is generally improved in proportion to the improvement in the hardness of the steel. On the other hand, a fact is known that the fatigue resistance is also affected by the size of non-metallic inclusions contained in the steel. As for the former influence, the fatigue resistance required to serve as the material for a mechanical part is realized by hardening and tempering to be performed in the secondary manufacturing process. In this case, the behavior in solution of the graphite particles considerably depends upon the size of the graphite. That is, if the graphite particles are rough and large, graphite cannot be solid-solved sufficiently by heating performed in a short time and, accordingly, the hardness after hardening/tempering is impaired, causing the fatigue resistance to deteriorate. Since graphite is a type of non-metallic inclusions, non-solved graphite present due to the fact that the graphite is rough and large results in the foregoing portion acts as a starting point of the fatigue failure. In this case, the fatigue resistance deteriorates excessively beyond the degree expected from the overall hardness. The foregoing tendency becomes apparent in proportion to the strength.

As a result, the fatigue resistance of hardened and tempered graphite steel can be improved by fining graphite because of the two considerations. The investigation performed by the inventors of the present invention revealed that the critical size of graphite affecting fatigue resistance is about 20 μm. If the graphite is larger than 20 μm, the solution of graphite does not proceed in a short time, so that the fatigue strength is reduced.

As described above, it was discovered that the cutting characteristic, the cold forging characteristic and the fatigue resistance of the steel for a machine structural use can effectively be improved by fining the size of the graphite particles.

The graphite steel of the invention is intended, although not exclusively, to be used as material for automotive structural parts after hardening/tempering following mechanical working. In such uses, it is desirable that the fatigue strength and the durability ratio are not less than 460 MPa and 1.44, respectively.

The inventors of the present invention have further developed a manufacturing method that is capable of satisfying the foregoing requirements. The results of their study will now be described.

Initially, the composition of the steel according to the present invention is described as:

C: 0.1 wt % to 1.5 wt %

Carbon (C) is an essential component for forming the graphite phase. If C is less than 0.1 wt %, the graphite phase required to maintain the cutting characteristic cannot easily be maintained. Therefore, C must be added by 0.1 wt % or more. If C is added by a quantity larger than 1.5 wt %, deformation resistance at the time of the hot rolling process is intensified. In addition, the deforming capability deteriorates, thus increasing cracks and making critical the damage of the hot-rolled product. Therefore, the content was determined to be a range from 0.1 wt % to 1.5 wt %.

Si: 0.5 wt % to 2.0 wt %

Silicon (Si) is required to serve as a deoxidizer required in the melting process. In addition, Si is an effective element which is not solid-solved in iron carbide (cementite) in the steel and which makes the cementite unstable to enhance the forming of graphite. Furthermore, Si is a component that improves the strength. Therefore, Si is positively added. If the content is 0.5 wt % or less, the foregoing effects are unsatisfactory and it takes an excessively long time to form graphite. If Si is added in a quantity larger than 2.0 wt %, the effect of enhancing the forming of graphite is saturated and the temperature region, in which the liquid phase is generated, is lowered. As a result, the adequate temperature region for the hot rolling process is narrowed. Therefore, the content was limited to a range from 0.5 to 2.0 wt %.

Mn: 0.1 wt % to 2.0 wt %

Since manganese (Mn) is an element which is effective to deoxidize steel and which is an element to improve the hardenability to maintain the strength of the steel, it is positively added. However, Mn is solid-solved in cementite so that the forming of graphite is hindered. If Mn is added by a quantity less than 0.1 wt %, neither deoxidizing effect nor satisfactory contribution to the improvement in the strength can be obtained. Therefore, Mn must be added by 0.1 wt % or more. If the content exceeds 2.0 wt %, graphite forming is hindered. As a result, the content was limited to a range from 0.1 wt % to 2.0 wt %.

B: 0.0003 wt % to 0.0150 wt %

Boron (B) is combined with nitrogen (N) contained in the steel to form BN serving as nucleus forming sites so as to enhance the forming and fining graphite. Since boron is as well as an important element to improve the characteristics of hardening steel to maintain the strength of the hardened steel, boron is an important component in the present invention. If the quantity of added boron is less than 0.0003 wt %, the effects of forming graphite and improving the hardening characteristic are unsatisfactory. Therefore, boron must be added by 0.0003 wt % or more. If it is added in a quantity exceeding 0.0150 wt %, boron is solid-solved in cementite so that the cementite is stabilized and therefore graphite forming is hindered. Hence, the content was limited to a range from 0.0003 wt % to 0.0150 wt %.

Al: 0.005 wt % to 0.1 wt %

Since aluminum (Al) aids deoxidation and is combined with N contained in the steel to form AlN serving as nucleus forming sites so as to enhance the forming of graphite, it is added positively. If it is added by a quantity smaller than 0.005 wt %, the foregoing effects are unsatisfactory. Therefore, aluminum must be added by 0.005 wt % or more. If aluminum is added by 0.1 wt % or more, an excessively large number of Al-type oxides are undesirably generated in the forgoing process. The oxides serve as starting points of the fatigue failure if only the oxides are present. Moreover, the oxides form excessively large and rough graphite in such a manner the oxides are the nuclei. Since the Al-type oxides are hard substances, they wear machining tools and thus the cutting characteristic deteriorate. Because of the foregoing reasons, the quantity of aluminum to be added was ranged from 0.005 wt % to 0.1 wt %.

O: 0.0030 wt % or less

Since oxygen (0) forms oxide-type non-metallic inclusions which deteriorate the cold forging characteristic, the cutting characteristic and the fatigue resistance, it must be minimized. However, an allowable upper limit of the content is 0.0030 wt %.

P: 0.020 wt % or less

Phosphorus (P) is an element which hinders the forming of graphite and embrittles the ferrite layer, phosphorus being therefore an element that deteriorates the cold forging characteristic. It segregates on the grain boundary at the time of the hardening and tempering processes and thus deteriorates the strength of the grain boundary. As a result, phosphorus deteriorates resistance against the propagation of fatigue cracks and deteriorates the fatigue strength. Therefore, it must be minimized while being allowed to present by a quantity less than 0.020 wt %.

S: 0.035 wt % or less

Sulfur (S) forms MnS in the steel, MnS acting as the starting point of cracks at the cold forging process that deteriorates the cold forging characteristic. What is worse, MnS serves as the starting point of the fatigue failure and acts as the nuclei of the crystallization of graphite so that it forms excessively rough and large graphite. As a result, the fatigue resistance deteriorates. Therefore, it must be minimized while being allowed to present in a quantity less than 0.035 wt %.

N: 0.0015 to 0.0150 wt %

Since nitrogen (N) combines with boron to form BN which serves as the nuclei of the crystallization of graphite, graphite particles can be fined considerably and the forming of graphite is enhanced significantly. Therefore, it is an essential element in the present invention. If nitrogen is added by a quantity less than 0.0015 wt %, BN cannot be formed satisfactorily. If nitrogen is added by a quantity larger than 0.0150 wt %, cracks of cast pieces are enhanced at the time of a continuous casting process. Therefore, the content was ranged from 0.0015 wt % to 0.0150 wt %.

In the present invention, one or more types of components selected from a groups consisting of REM, Zr, Ti, V, Nb, Ni, Cu, Co and Mo are effectively added to the foregoing main components if necessary so as to enhance the effects of the foregoing main components and realize and improve the other characteristics. The reason for determining the composition of the foregoing components to be added will now be described.

REM: 0.0005 wt % to 0.2 wt %

La and Ce of REM combine with S to form LaS and CeS which serve as nuclei of the forming of graphite, thus enhancing the forming of graphite and fining graphite particles. If REM is added by a quantity less than 0.0005 wt %, the foregoing effect is unsatisfactory. If it is added in a quantity larger than 0.2 wt %, the effect is saturated. Therefore, the content was ranged from 0.0005 wt % to 0.2 wt %.

Zr: 0.005 wt % to 0.2 wt %/Ti: 0.005 wt % to 0.05 wt %

Both Zr and Ti respectively form carbides and nitrides that serve as nuclei of the crystallization of graphite so that graphite particles are fined. Therefore, an effect can be obtained in a case where further fining of graphite particles is required. By forming carbides and nitrides, boron can be caused to act to obtain hardening characteristics at the time of the hardening process. In order to cause the foregoing effects to be exhibited, Zr and Ti must be respectively added by 0.005 wt % or more. If Zr and Ti are respectively added by 0.2 wt % or more and 0.05 wt % or more, more N for forming BN would be needed. As a result, graphite particles are roughened and enlarged excessively and the time required to form graphite is lengthened excessively. Therefore, the contents were ranged from 0.005 to 0.2 wt % and from 0.005 wt % to 0.5 wt %, respectively.

V: 0.05 wt % to 0.5 wt %/Nb: 0.005 wt % to 0.05 wt %

Although both V and Nb are elements which form carbides, they are not substantially solid-solved in cementite. Therefore, the graphite forming is not hindered considerably. Furthermore, they form carbides and nitrides so that V and Nb improve the strength due to the effect of enhancing precipitation. Since they are elements which improve the hardening characteristic, it is preferable to use them in a case where an improvement in the fatigue resistance is required. If V is added in a quantity less than 0.05 wt %, the foregoing effects are unsatisfactory. If it is added in a quantity larger than 0.5 wt %, the effects are saturated. Therefore, the content was ranged from 0.05 wt % to 0.5 wt %. If Nb is added in a quantity less than 0.005 wt %, the foregoing effects are unsatisfactory. If it is added in a quantity exceeding 0.05 wt %, the effects are saturated. Therefore, the content was ranged from 0.005 wt % tot 0.05 wt %.

Ni, Cu, Co: each 0.1 wt % to 3.0 wt %

The foregoing elements have a common effect of enhancing graphite forming. Since each of the foregoing elements has an effect of improving the hardening characteristic, they are able to improve the hardening characteristic while maintaining the graphite forming. If the content of each of the foregoing elements is less than 0.1 wt %, the foregoing effect is unsatisfactory. If each of the foregoing elements is added by 3.0 wt % or more, the foregoing effects are saturated. Therefore, the content was ranged from 0.1 to 3.0 wt %.

Mo: 0.1 to 1.0 wt %

Molybdenum (Mo) improves the hardening characteristic and it is characterized in small distribution to cementite as compared with Mn or Cr. Therefore, molybdenum is able to improve the performance of hardening the steel while maintaining the capability of forming graphite. Since steel containing molybdenum added thereto has large resistance against softening at the time of the tempering process, the hardness can be improved even if the tempering is performed at the same tempering temperature. Therefore, the fatigue resistance can be improved. Since molybdenum exhibits an excellent hardening characteristic, a bainite structure forming fine graphite can easily be realized in a state where the steel is subjected to only the hot rolling process. As a result, solution of graphite at the time of the hardening process can be completed in a short time. Therefore, molybdenum is used in a case where the fatigue resistance can further be improved. If it is added in a quantity less than 0.1 wt %, the foregoing effects are unsatisfactory. If it is added in a quantity exceeding 1.0 wt %, graphite forming is inhibited, thus causing the cold forging characteristic and the cutting characteristic to deteriorate. Therefore, the content was ranged from 0.1 wt % to 1.0 wt %. In order to fine graphite particles, a multiplicity of precipitations serving as nucleus forming sites at the time of crystallizing graphite in the steel must be generated. For the precipitations, it is effective to employ BN, AlN, TiN, ZrN, Nb(C, N), V(C, N), or (La, Ce)S. Among the foregoing substances, BN acts as the most effective substance serving as the sites for crystallizing graphite. Also AlN effectively serves as a nucleus at the time of crystallizing graphite. If BN and AlN are used in a combined manner, the foregoing effects can further be improved.

However, the effects of Al and B added to the steel to fine graphite cannot satisfactorily be exhibited by only adding Al and B by quantities ranged as described above. Furthermore, hot rolling conditions and annealing conditions must be combined to cause BN and AlN to coexist.

That is, it is important to completely solid-solve BN and AlN at the time of the heating step in the hot rolling process. The reason for this is that the precipitations in the steel are toughened and enlarged and the number of the same is decreased in a temperature region in which the precipitations in the steel cannot completely be solid-solved, thus causing the formed graphite particles to be toughened, enlarged and decreased excessively. If the steel is hot-rolled after it has been heated to a temperature region in which BN and AlN can completely be solid-solved, BN finely precipitates in the cooling process after the hot rolling operation and AlN finely precipitates in the heating process in the annealing process for forming graphite. As a result, the size of the graphite particles can be reduced.

However, graphite cannot satisfactorily be fined by only completely solid-solving BN and AlN at the heating step to be performed before the commencement of the hot rolling process. Therefore, annealing conditions, and more particularly, the heating rate at the annealing process, must be controlled.

That is, when BN and AlN are completely solid-solved in the heating step to be performed before the hot rolling process, they must extremely quickly be precipitated in the cooling step to be performed after the hot rolling process. However, the low dispersion speed of Al causes substantially no precipitation of AlN to take place in the cooling step, resulting in that Al is present in the form of solid-solved Al. If annealing for forming graphite is commenced in the foregoing state, solid-solved Al(s) is combined with solid-solved N(s) to take place the following reaction:

$$Al(s)+N(s)\rightarrow AlN$$

Simultaneously with this, Al(s) as well as reacts with BN formed previously to take place the following reaction:

$$Al(s)+BN\rightarrow AlN+B$$

The former reaction mainly takes place in a low temperature region, while the latter reaction proceeds in a relatively-hot region.

Therefore, if a hot-rolled material is immediately annealed at high temperature, boron generated due to the latter reaction is solid-solved in cementite, thus causing the cementite to be stabilized. As a result, proceeding of the graphite forming is considerably lowered. In addition, BN serving as nucleus at the time of forming graphite and enhancing the foregoing effect is decreased, thus resulting in that the amount of graphite decreases. Therefore, the particle size is roughly enlarged excessively.

Therefore, proceeding of the foregoing reaction must be prevented and the following reaction must proceed:

$$Al(s)+N(s)\rightarrow AlN$$

Accordingly, the present invention intends to cause the foregoing reaction to proceed with priority to lengthen the residence time in the low temperature region. In order to achieve this, the heating speed is restricted to a level slower than a certain limit or maintaining in the low temperature region.

The hot rolling conditions and annealing conditions for forming graphite will now be described in detail.

In the present invention, the temperature at which steel is heated at the time of the hot rolling process is made to be higher than the solid-solution temperature for BN and that for AlN.

If the heating temperature at the hot rolling process is lower than the foregoing level, BN serving as nuclei for crystallizing graphite cannot completely be solid-solved and therefore BN is roughened and enlarged excessively. As a result, excessively rough and large graphite particles are generated at the annealing step for forming graphite to be performed after the hot rolling process has been performed. Therefore, the cutting characteristic, the cold forging characteristic and the fatigue resistance deteriorate as described above. However, if BN and AlN are completely solid-solved at the heating step to be performed before the hot rolling process, BN is finely precipitated at the cooling step to be performed after the hot rolling process and AlN is finely precipitated at the heating step in the annealing process for forming graphite to serve as nuclei at the time of crystallizing graphite. As a result, graphite particles are fined so that the fatigue resistance, the cutting characteristic and the cold forging characteristic are improved.

As described above, the heating temperature for completely solid-solving BN and AlN can be determined by the following calculations for obtaining the following solubility product:

$$\log [Al]\cdot[N]=-7400/T+1.95$$

$$\log [B]\cdot[N]=-13970/T+5.24$$

where [Al],[N] and [B] respectively are quantities of added A1, N and B, and T is absolute temperature.

Although the finish rolling temperature to be set in the hot rolling process and conditions for cooling the steel to be performed after the finish rolling process are not limited in the present invention, it is preferable that the finish rolling temperature be higher than the temperature at which γ particles are re-crystallized. The reason for this is that BN acting as the nuclei at the time of crystallizing graphite and formed in the γ-grain boundary is distributed further finely and uniformly if γ grains are fined.

As for the cooling rate, if the cooling rate is very low, precipitated BN is roughened and enlarged excessively and thus graphite is roughened and enlarged excessively, causing the cutting characteristic, the cold forging characteristic and the fatigue resistance to deteriorate. Therefore, it is preferable that the cooling rate be not lower than 0.01° C./s.

The annealing conditions that are the most important factor for the present invention will now be described.

A first means of the method of heat-treating steel according to the present invention is to perform an annealing process having two stages including a holding process to be performed during the heat rising process.

A first stage of the foregoing annealing method is a process in which the temperature is raised to a level ranged from 300° C. to 600° C. and this level is maintained for 15 minutes Or longer. In this process, reaction Al+N→AlN proceeds with priority to a reaction Al+BN→AlN+B, thus resulting in that BN serving as the nuclei at the time of crystallizing graphite is not decreased but AlN serving as the nuclei for forming graphite can be formed. The reason why the lower limit is determined to be 300° C. is that the speed at which the reaction Al+N→AlN is lowered if the temperature is lower than the foregoing level and thus a problem takes place in a practical use. The reason why the upper limited is determined to be 600° C. is that the reaction Al+BN→AlN+B proceeds with priority if the temperature is higher than the foregoing level.

The reason why the holding time in the temperature region from 300° C. to 600° C. is determined to be 15 minutes or longer is that if the holding is performed for a shorter time, the reaction Al+N→AlN does not proceed satisfactorily but the reaction Al+BN→AlN+B easily proceeds due to the holding process to be performed afterwards.

A second stage in the foregoing method is a process in which the temperature is heated to a range from 680° C. to 740° C. after the foregoing heating raising and holding stage and then the raised temperature level is maintained for 5 hours or longer. In this process, if the temperature is lower than 680° C., the graphite forming reaction proceeds too slowly to complete the graphite forming in a satisfactorily short time. If the temperature is higher than 740° C., a large quantity of γ-phases are generated in the steel and thus the graphite forming is prevented. The reason why the holding time is determined to be 5 hours or longer is that the graphite forming satisfying the cutting characteristic and the cold forging characteristic does not proceed if the time is shorter than the foregoing period.

Another heat treatment means according to the present invention is a method in which normalizing is performed such that the temperature is initially raised to a range from 800° C. to 950° C. and the heated steel is cooled by air and in which the temperature is raised to a range from 680° C. to 740° C. and the raised level is maintained for 5 hours or longer.

The reason why the foregoing normalizing is performed will now be described. The major portion of added Al is solid-solved in the steel and substantially no AlN is present in the same in a state the steel has been subjected to only the hot rolling process. If the temperature is raised from the foregoing state to the γ-region in which the temperature is relatively low, a portion of the solid-solved Al is finely precipitated as AlN. Since the temperature is relatively low, the AlN is enlarged at a very low rate and precipitated AlN having a small size is maintained. The presence of fine AlN causes γ-grains to be held finely during the heating process.

On the other hand, BN is precipitated finely in a state where the steel has been subjected to only the hot rolling process. Although a portion of BN is solid-solved in the γ-phase due to the rise of the temperature to the γ-region, a portion is not solid-solved and present as BN. However, since the holding temperature is relative low, the enlargement rate of non-solid-solved BN is also low during a period in which it is held. Therefore, BN is maintained in the form of fine BN. Although solid-solved B is again precipitated in the cooling process to be performed after the holding process has been performed, BN has a characteristic of precipitating into the γ-grain boundary, with which the effects of fine AlN maintain the γ-grains at fine state. Therefore, BN can be finely and uniformly dispersed at the time of the re-precipitation. As a result, BN consists of a portion precipitated finely at the time of the hot rolling process and a portion solid-solved and re-precipitated at the normalization process, causing the number of BN particles to be increased considerably.

Because of the foregoing reasons, use of AlN and BN each present in the form of fine particles as nuclei at the time of forming graphite enables finer graphite to be formed.

The reason why the lower limit of the foregoing process is determined to be 800° C. is that the γ-grain forming does not completely proceed if the temperature is lower than the foregoing level. In this case, the distribution of the again precipitated BN becomes excessively non-uniform, thus causing the distribution of graphite particles in the final graphite structure to become excessively irregular. The reason why the upper limit is determined to be 950° C. is that the rate of the enlargement of the precipitated AlN and BN is lowered excessively and γ-grains becomes too rough and excessively large if the temperature is higher than the foregoing level. In this case, fine AlN and BN cannot be obtained and, thus, desired fine graphite particles cannot be obtained.

A third means of the heat treatment method according to the present invention is a method in which a normalizing process is performed and then an annealing process is performed which comprises two steps of annealing steps consisting of a process of maintaining temperature of 300° C. to 600° C. for 15 minutes or longer and a process of maintaining temperature of 680° C. to 740° C. for 5 hours or longer. The foregoing process enables multiplier effects of the respective heat treatment processes to be obtained.

The present invention will now be described by providing examples.

Steel examples respectively having compositions shown in Table 1 were manufactured by a melting method consisting of a converter process and a continuous casting process so that blooms, each of which was 450 mm×500 mm, were manufactured. Referring to Table 1, steel examples A to N are those having compositions according to the present invention, while steel examples O to R are those containing B, P, Al and Si in manners which do not agree with the range of the present invention. Steel examples S to U respectively are steel equivalent to S30C steel conforming to JIS, free-cutting steel obtained by adding S, Ca and Pb which are elements of S45C steel for improving free cutting characteristics, and SCM 435 steel which is Cr-Mo steel. Since Example Steel S exhibits excellent cold forging characteristic, it has been employed as cold forged steel, Example Steel T, which is free-cutting steel obtained by adding S, Ca and Pb to S45C steel, and which exhibits excellent cutting characteristic has been employed as steel for use in a case where excellent cutting characteristic are required, and Example Steel U, which is SCM 435 steel, has been employed to form mechanical parts which must have excellent fatigue resistance because of its excellent hardening characteristics, satisfactory mechanical characteristics and fatigue resistance against rotary bending.

The thus-manufactured blooms were formed into 150 mm×150 mm billets by a cogging mill method, and each of the billets was rolled into the form of a ϕ52 mm steel bar. Then, the steel bars were subjected to an annealing process for forming graphite in an annealing furnace.

Note that the hot rolling process was performed in such a manner that the solid-solution temperature for BN and that for AlN obtained from the composition of the steel were calculated and the rolling temperature was determined on the basis of the solid-solution temperatures. Furthermore, the annealing process for forming graphite was performed until C in the steel was completely formed into graphite.

The heating temperatures, the normalizing conditions and the annealing conditions to be set in the hot rolling process are collectively shown in Tables 2 to 5. It should be noted that the graphite forming process for samples in which the graphite forming did not proceed satisfactorily though it was subjected to the annealing process for 100 hours or longer, was interrupted. Symbols ** in the column "holding time" shown in Tables 3 to 5 indicate interruption of the graphite forming process.

Tables 6 to 9 show the results of measurements of steel examples A to U subjected to the processes under conditions shown in Tables 2 to 5, the measurements being performed about the graphite particle size, hardness of the steel in as-annealed state, cold forging characteristic, cutting characteristic, mechanical characteristics after the hardening and tempering processes, and the fatigue resistance against rotary bending after the hardening and tempering processes.

The graphite particle size was measured in such a manner that samples to be observed by an optical microscope were manufactured from the annealed materials and the diameters of 1000 to 2000 or more graphite particles were measured by an image analyzer. The hardness of the steel subjected to only the annealing process was measured by using a Vicker's hardness meter.

The cold forging characteristic was measured in such a manner that cylindrical test samples each 15 mm in diameter and 22.5 mm long were manufactured from the annealed raw materials. Then the samples were subjected to a compressing test by using a 300-ton press and resistance against deformation was calculated from loads added at the test. The deformation resistance was expressed in terms of resistance to deformation as exhibited when the compression ratio (height reduction) was set to 60%. Whether or not cracks had been present on the side surface of the test sample was confirmed to make the compression ratio, at which the half of the tested samples were cracked, to be the limit compression ratio which was the index of the deformation capability.

The cutting characteristic test was performed in such a manner that high speed tool steel SKH4 was used to cut the outer surface under conditions that the cutting speed was 80 m/minute without lubrication. The time taken to the moment the tool could not cut the material was made to be the life of the tool, which was evaluated.

The characteristics realized after the hardening process and the tempering process were evaluated in such a manner that samples, the diameter of each of which was 15 mm and the length of each of which was 85 mm, were manufactured from the raw material, heated at 900° C. for 30 minutes, hardened in a water-soluble hardening fluid, held at 500° C. for one hour, and tempered by water cooling. Then, tensile resistance test samples each having a diameter of 8 mm were manufactured to be subjected to tensile resistance test.

The rotary bending fatigue test was performed in such a manner that hardening and tempering processes similar to the above were performed, test samples each having a diameter of 8 mm were manufactured, and an Ono Rotary Bending Fatigue testing machine was used at a speed of 3600 rpm at room temperature.

The results are collectively shown in Tables 6 to 9.

Since the conventional steel samples could not be formed into graphite, they were subjected to usual manufacturing process in such a manner that Example Steel S (equivalent to S30C steel) and Example Steel U (equivalent to SCM435 steel) were subjected to spheroidizing annealing process, in which the samples were held at 745° C. for 15 hours and cooled gradually, and then they were subjected to the foregoing tests under the same conditions as those of the foregoing test samples. The steel obtained by adding S, Ca and Pb to the S45C steel was subjected to the tests in such a manner that only the cutting characteristic of the rolled sample was evaluated and other tests were performed after the sample was subjected to the spheroidizing annealing process in which the sample was held at 745° C. for 15 hours and cooled gradually. The hardness of No. 73 shown in Table 9 was the hardness of the sample subjected to only the rolling process.

As shown in Tables 2 to 5, graphite forming of the samples heated to a level higher than the solid-solving temperatures for BN and AlN as specified in the present invention and the samples satisfying the annealing conditions, was completed in a short time although somewhat different results took place, depending upon the type of the steel.

However, even if the intermediate maintaining step was performed as was done with No. 11, the time taken to complete the graphite forming was longer than that of the range specified by the present invention in a case where the maintaining temperature was lower than the range according to the present invention as confirmed with No. 11.

In a case where the foregoing heating temperature set at the hot rolling process is not included in the range according to the present invention (as confirmed with No. 19 for example), the annealing time was shorter than the case (No. 18) in which only the heating temperature was included in the range according to the present invention and the annealing conditions were not included in the range of the present invention. However, the annealing time was longer than that taken for the sample (No. 17) according to the present invention.

In a case where the composition is not included in the, range according to the present invention, for example, in a case of Example Steel O, the quantity of B which was not included in the range according to the present invention, the time taken to form graphite was about four times longer than that required for Example Steel C. In a case of Example Steel P, the quantity of P of which was not included in the range according to the present invention, the time taken to complete the annealing process was about two times or longer than that required for Example Steel C. In a case of Example Steel Q, the quantity of Al of which was not included in the range according to the present invention, graphite forming was not considerably affected by the rolling temperature and the annealing conditions. Example Steel R having Si content falling out of the range of invention did not form graphite although the hot rolling temperature and the annealing conditions according to the present invention were employed.

As shown in the "graphite structure" included in each of Tables 6 to 9, the graphite particle size of each of the examples according to the present invention was smaller than 17 μm. As contrasted with this, the samples, which were not included in the range according to the present invention, contain excessively large and rough graphite particles, the size of which was about 35 μm or smaller. In addition, the hardness and the deformation resistance realized at the cold forging process were not affected by the graphite particle size. However, the limit compression ratio and the cutting characteristic (the life of the machining tool) deteriorated in a case where the graphite particle size was roughly enlarged. In a case where the composition was not included in the range according to the present invention, and, as well, the graphite particles are rough and large, the mechanical characteristics of each sample were determined after the hardening process and the tempering process had been completed. It was not satisfactory because the solution of graphite took place slowly and thus the hardening characteristics deteriorated, thus resulting in that YS and TS were reduced while reducing EL and RA.

In comparison made between the method according to the present invention and the conventional method, the deformation resistance and the limit compression ratio at the cold forging process are superior to those of S30C steel. Also the cutting characteristic is superior to that of free cutting steel manufactured by adding Pb, Ca and S to S45C steel. In addition, the fatigue resistance of the samples according to the present invention is superior to that of SCM435. In a case where the hot rolling conditions and the annealing conditions do not satisfy the conditions according to the present invention and only the composition satisfies the range according to the present invention, cold forging characteristic and cutting characteristic under some conditions enabled characteristics equivalent or superior to those of the conventional steel to be obtained. Therefore, in a case where only the foregoing characteristics are required, the hot rolling conditions and the annealing conditions are not required to be within the range of the present invention.

As for the fatigue resistance, the samples according to the present invention resulted in fatigue resistance of about 1.5 to 1.7 times the hardness. Thus, a correlation with the hardness was confirmed. The samples that were not included in the range of the present invention and the steel manufactured by adding Pb, Ca and S to S45C steel resulted in the fatigue resistance which did not correspond to the same hardness. This is due to a fact that the samples which are not included in the range according to the present invention include large graphite particles causing non-solid-solved graphite to interpose. In a case of the free cutting steel manufactured by adding Pb, Ca and S to S45C steel, rough and large non-metal inclusions that improve the cutting characteristic interpose. Each of the foregoing inclusions serves as the starting point of the fatigue failure.

Although no Ca is added in the present invention, addition of Ca is effective to enhance the forming of graphite and to improve the cutting characteristic in a case where the fatigue resistance is not required.

As described above, according to the present invention, graphite can be formed in a short time and as well as obtained graphite particles can be fined. Therefore, steel can be obtained which has cutting characteristic equivalent or superior to that of the conventional Pb free cutting steel without a necessity of using Pb and which exhibits excellent cold forging characteristic, mechanical characteristics realized after the hardening and tempering processes and fatigue resistance. Therefore, a great advantage can be realized in manufacturing mechanical parts.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

TABLE 1

| TYPE OF STEEL | COMPOSITION (wt %) C | Si | Mn | P | S | Al | B | N | O | REM | Zr |
|---|---|---|---|---|---|---|---|---|---|---|---|
| A | 0.25 | 1.85 | 0.42 | 0.008 | 0.012 | 0.035 | 0.0012 | 0.0026 | 0.0008 | — | — |
| B | 0.43 | 1.65 | 0.42 | 0.006 | 0.006 | 0.043 | 0.0018 | 0.0033 | 0.0007 | — | — |
| C | 0.53 | 1.75 | 0.58 | 0.012 | 0.015 | 0.036 | 0.0019 | 0.0037 | 0.0006 | — | — |
| D | 0.69 | 1.45 | 0.62 | 0.013 | 0.015 | 0.038 | 0.0017 | 0.0041 | 0.0008 | — | — |
| E | 0.89 | 1.21 | 0.78 | 0.013 | 0.015 | 0.039 | 0.0019 | 0.0041 | 0.0009 | — | — |
| F | 1.06 | 0.65 | 0.88 | 0.012 | 0.006 | 0.039 | 0.0026 | 0.0038 | 0.0008 | — | — |
| G | 0.55 | 1.62 | 0.55 | 0.011 | 0.005 | 0.038 | 0.0016 | 0.0029 | 0.0016 | — | — |
| H | 0.57 | 1.63 | 0.55 | 0.011 | 0.006 | 0.039 | 0.0032 | 0.0017 | 0.0009 | — | — |
| I | 0.58 | 1.55 | 0.55 | 0.011 | 0.004 | 0.037 | 0.0078 | 0.0031 | 0.0011 | — | — |
| J | 0.54 | 1.45 | 0.55 | 0.011 | 0.008 | 0.069 | 0.0022 | 0.0077 | 0.0012 | — | — |
| K | 0.56 | 1.65 | 0.55 | 0.011 | 0.009 | 0.071 | 0.0018 | 0.0137 | 0.0009 | — | 0.18 |
| L | 0.56 | 1.63 | 0.56 | 0.012 | 0.008 | 0.072 | 0.0036 | 0.0036 | 0.0007 | — | — |
| M | 0.54 | 1.63 | 0.57 | 0.012 | 0.009 | 0.048 | 0.0022 | 0.0035 | 0.0009 | — | — |
| N | 0.57 | 1.67 | 0.53 | 0.007 | 0.007 | 0.048 | 0.0012 | 0.0033 | 0.0008 | 0.022 | — |
| O | 0.55 | 1.65 | 0.55 | 0.008 | 0.011 | 0.047 | — | 0.0077 | 0.0006 | — | — |
| P | 0.55 | 1.66 | 0.55 | 0.026 | 0.011 | 0.045 | 0.0013 | 0.0046 | 0.0008 | — | — |
| Q | 0.55 | 1.63 | 0.54 | 0.004 | 0.003 | 0.004 | 0.0008 | 0.0049 | 0.0008 | — | — |
| R | 0.54 | 0.42 | 0.55 | 0.007 | 0.009 | 0.045 | 0.0019 | 0.0066 | 0.0015 | — | — |
| S | 0.31 | 0.25 | 0.75 | 0.015 | 0.012 | 0.025 | — | 0.0075 | 0.0007 | — | — |
| T | 0.47 | 0.25 | 0.78 | 0.013 | 0.059 | 0.025 | — | 0.0065 | 0.0015 | — | — |
| U | 0.35 | 0.25 | 0.85 | 0.012 | 0.010 | 0.027 | — | 0.0053 | 0.0015 | — | — |

| TYPE OF STEEL | COMPOSITION (wt %) Ti | V | Nb | Ni | Cu | Co | Mo | Cr | Ca | Pb | CLASSIFICATION |
|---|---|---|---|---|---|---|---|---|---|---|---|
| A | — | — | — | — | — | — | — | — | — | — | EXAMPLE |
| B | — | — | — | — | — | — | — | — | — | — | " |
| C | — | — | — | — | — | — | — | — | — | — | " |
| D | — | — | — | — | — | — | — | — | — | — | " |
| E | — | — | — | — | — | — | — | — | — | — | " |

TABLE 1-continued

| | | | | | | | | | | | |
|---|---|---|---|---|---|---|---|---|---|---|---|
| F | — | — | — | — | — | — | — | — | — | — | " |
| G | — | — | — | — | — | — | 0.35 | — | — | — | " |
| H | — | — | — | — | 0.15 | — | 0.35 | — | — | — | " |
| I | — | — | — | 1.6 | 0.15 | — | 0.45 | — | — | — | " |
| J | 0.015 | — | — | — | — | — | 0.45 | — | — | — | " |
| K | 0.012 | — | — | — | — | 1.1 | 0.35 | — | — | — | " |
| L | — | 0.25 | — | — | — | — | 0.35 | — | — | — | " |
| M | — | 0.15 | 0.03 | — | — | — | — | — | — | — | " |
| N | — | 0.16 | 0.02 | — | — | — | — | — | — | — | " |
| O | — | — | — | — | — | — | — | — | — | — | COMPARATIVE EXAMPLE |
| P | — | — | — | — | — | — | — | — | — | — | COMPARATIVE EXAMPLE |
| Q | — | — | — | — | — | — | — | — | — | — | COMPARATIVE EXAMPLE |
| R | — | — | — | — | — | — | — | — | — | — | COMPARATIVE EXAMPLE |
| S | — | — | — | — | — | — | — | — | — | — | CONVENTION EXAMPLE |
| T | — | — | — | — | — | — | — | — | 0.0068 | 0.07 | CONVENTION EXAMPLE |
| U | — | — | — | — | — | — | 0.21 | 1.1 | — | — | CONVENTION EXAMPLE |

TABLE 2

| | | TEMPERATURE RAISED AT HOT ROLLING | | | NORMALIZING CONDITION | |
|---|---|---|---|---|---|---|
| No. | EXAMPLE STEEL | SOLID-SOLUTION TEMPERATURE FOR BN (°C.) | SOLID-SOLUTION TEMPERATURE FOR AIN (°C.) | HEATING TEMPERATURE (°C.) | MAINTAINING TEMPERATURE (°C.) | PERIOD MAINTAINED (h) |
| 1 | A | 1025 | 959 | 1100 | — | — |
| 2 | A | " | " | 1055 | — | — |
| 3 | A | " | " | 1065 | 850 | 1 |
| 4 | A | " | " | 1000 | — | — |
| 5 | B | 1060 | 1000 | 1100 | — | — |
| 6 | B | " | " | 1061 | 850 | 1 |
| 7 | B | " | " | 960 | — | — |
| 8 | B | " | " | 1125 | 875 | 0.5 |
| 9 | C | 1073 | 1000 | 1115 | — | — |
| 10 | C | " | " | 1117 | — | — |
| 11 | C | " | " | 1084 | — | — |
| 12 | C | " | " | 1034 | — | — |
| 13 | D | 1072 | 1015 | 1115 | — | — |
| 14 | D | " | " | 1090 | — | — |
| 15 | D | " | " | 1120 | 900 | 0.5 |
| 16 | D | " | " | 1154 | — | — |
| 17 | E | 1080 | 1019 | 1095 | — | — |
| 18 | E | " | " | 1123 | — | — |
| 19 | E | " | " | 1005 | 850 | 1 |
| 20 | E | " | " | 1025 | — | — |
| 21 | E | " | " | 1110 | — | — |

| | ANNEALING CONDITION | | | | |
|---|---|---|---|---|---|
| | FIRST STAGE | | SECOND STAGE | | |
| No. | TEMPERATURE (°C.) | HOLDING TIME (min) | TEMPERATURE (°C.) | HOLDING TIME (h) | CLASSIFICATION |
| 1 | 350 | 35 | 689 | 15.6 | EXAMPLE |
| 2 | — | — | 700 | 47.1 | COMPARATIVE EXAMPLE |
| 3 | — | — | 700 | 15.6 | EXAMPLE |
| 4 | — | — | 700 | 34.2 | COMPARATIVE EXAMPLE |
| 5 | 500 | 18 | 685 | 16.2 | EXAMPLE |
| 6 | 400 | 20 | 700 | 15.1 | EXAMPLE |
| 7 | — | — | 710 | 24.4 | COMPARATIVE EXAMPLE |
| 8 | — | — | 685 | 16.3 | EXAMPLE |
| 9 | 325 | 65 | 695 | 15.8 | EXAMPLE |
| 10 | — | — | 695 | 47.4 | COMPARATIVE |

TABLE 2-continued

| | | | | | |
|---|---|---|---|---|---|
| 11 | 264 | 120 | 695 | 47.4 | EXAMPLE COMPARATIVE EXAMPLE |
| 12 | — | — | 700 | 23.7 | EXAMPLE COMPARATIVE EXAMPLE |
| 13 | 445 | 35 | 685 | 17.9 | EXAMPLE |
| 14 | 445 | 16 | 695 | 17.9 | EXAMPLE |
| 15 | 445 | 20 | 685 | 16.8 | EXAMPLE |
| 16 | — | — | 720 | 53.7 | COMPARATIVE EXAMPLE |
| 17 | 550 | 15 | 700 | 19.8 | EXAMPLE |
| 18 | — | — | 680 | 59.4 | COMPARATIVE EXAMPLE |
| 19 | — | — | 680 | 31.2 | COMPARATIVE EXAMPLE |
| 20 | — | — | 700 | 33.5 | COMPARATIVE EXAMPLE |
| 21 | 500 | 15 | 685 | 19.9 | EXAMPLE |

TABLE 3

| | | TEMPERATURE RAISED AT HOT ROLLING | | | NORMALIZING CONDITION | |
|---|---|---|---|---|---|---|
| No. | EXAMPLE STEEL | SOLID-SOLUTION TEMPERATURE FOR BN (°C.) | SOLID-SOLUTION TEMPERATURE FOR AlN (°C.) | HEATING TEMPERATURE (°C.) | MAINTAINING TEMPERATURE (°C.) | PERIOD MAINTAINED (h) |
| 22 | F | 1091 | 1007 | 1105 | — | — |
| 23 | F | " | " | 1151 | 845 | 0.5 |
| 24 | F | " | " | 1147 | — | — |
| 25 | F | " | " | 1049 | — | — |
| 26 | G | 1046 | 976 | 1076 | — | — |
| 27 | G | " | " | 1159 | — | — |
| 28 | G | " | " | 1167 | — | — |
| 29 | G | " | " | 1025 | — | — |
| 30 | H | 1054 | 929 | 1079 | — | — |
| 31 | H | " | " | 1088 | 832 | 1 |
| 32 | H | " | " | 1067 | — | — |
| 33 | H | " | " | 1002 | — | — |
| 34 | I | 1148 | 989 | 1167 | — | — |
| 35 | I | " | " | 1198 | 923 | 1.5 |
| 36 | I | " | " | 1200 | — | — |
| 37 | I | " | " | 1045 | — | — |
| 38 | J | 1123 | 1145 | 1165 | — | — |
| 39 | J | " | " | 1168 | 835 | 1.7 |
| 40 | J | " | " | 1165 | — | — |
| 41 | J | " | " | 1085 | — | — |

| | ANNEALING CONDITION | | | | |
|---|---|---|---|---|---|
| | FIRST STAGE | | SECOND STAGE | | |
| No. | TEMPERATURE (°C.) | HOLDING TIME (min) | TEMPERATURE (°C.) | HOLDING TIME (h) | CLASSIFICATION |
| 22 | 445 | 25 | 660 | 25.5 | EXAMPLE |
| 23 | — | — | 680 | 25.5 | EXAMPLE |
| 24 | — | — | 680 | 76 | COMPARATIVE EXAMPLE |
| 25 | — | — | 680 | 54.8 | COMPARATIVE EXAMPLE |
| 26 | 452 | 35 | 695 | 16.8 | EXAMPLE |
| 27 | — | — | 695 | 50.4 | COMPARATIVE EXAMPLE |
| 28 | 452 | 35 | 745 | ** | COMPARATIVE EXAMPLE |
| 29 | — | — | 700 | 32.7 | COMPARATIVE EXAMPLE |
| 30 | 557 | 16 | 685 | 15.4 | EXAMPLE |
| 31 | — | — | 700 | 15.4 | EXAMPLE |
| 32 | — | — | 700 | 45.6 | COMPARATIVE EXAMPLE |
| 33 | — | — | 700 | 32.8 | COMPARATIVE EXAMPLE |

TABLE 3-continued

| | | | | | |
|---|---|---|---|---|---|
| 34 | 421 | 32 | 695 | 9.2 | EXAMPLE |
| 35 | — | — | 700 | 9.2 | EXAMPLE |
| 36 | — | — | 700 | 29.8 | COMPARATIVE EXAMPLE |
| 37 | 421 | 32 | 695 | 20.4 | COMPARATIVE EXAMPLE |
| 38 | 375 | 60 | 730 | 16.4 | EXAMPLE |
| 39 | — | — | 725 | 16.4 | EXAMPLE |
| 40 | — | — | 710 | 50.9 | COMPARATIVE EXAMPLE |
| 41 | — | — | 705 | 24.6 | EXAMPLE COMPARATIVE |

TABLE 4

| | | TEMPERATURE RAISED AT HOT ROLLING | | | NORMALIZING CONDITION | |
|---|---|---|---|---|---|---|
| No. | EXAMPLE STEEL | SOLID-SOLUTION TEMPERATURE FOR BN (°C.) | SOLID-SOLUTION TEMPERATURE FOR AlN (°C.) | HEATING TEMPERATURE (°C.) | MAINTAINING TEMPERATURE (°C.) | PERIOD MAINTAINED (h) |
| 42 | K | 1146 | 1219 | 1235 | — | — |
| 43 | K | " | " | 1250 | 945 | 0.5 |
| 44 | K | " | " | 1235 | — | — |
| 45 | K | " | " | 1142 | — | — |
| 46 | L | 1108 | 1066 | 1165 | — | — |
| 47 | L | " | " | 1135 | 835 | 2 |
| 48 | L | " | " | 1065 | — | — |
| 49 | M | 1078 | 1022 | 1125 | — | — |
| 50 | M | " | " | 1138 | 846 | 2 |
| 51 | M | " | " | 1149 | — | — |
| 52 | M | " | " | 972 | — | — |
| 53 | N | 1040 | 1014 | 1078 | — | — |
| 54 | N | " | " | 1125 | 845 | 1 |
| 55 | N | " | " | 1168 | — | — |
| 56 | N | " | " | 1038 | 850 | 1 |

| | ANNEALING CONDITION | | | | |
|---|---|---|---|---|---|
| | FIRST STAGE | | SECOND STAGE | | |
| No. | TEMPERATURE (°C.) | HOLDING TIME (min) | TEMPERATURE (°C.) | HOLDING TIME (h) | CLASSIFICATION |
| 42 | 450 | 19 | 687 | 7.1 | EXAMPLE |
| 43 | 568 | 25 | 690 | 7.1 | EXAMPLE |
| 44 | — | — | 735 | 25.6 | COMPARATIVE EXAMPLE |
| 45 | — | — | 755 | ‡ ‡ | COMPARATIVE EXAMPLE |
| 46 | 575 | 20 | 695 | 14.3 | EXAMPLE |
| 47 | — | — | 695 | 14.3 | EXAMPLE |
| 48 | — | — | 695 | 50 | COMPARATIVE EXAMPLE |
| 49 | 350 | 60 | 710 | 15.7 | EXAMPLE |
| 50 | — | — | 720 | 15.7 | EXAMPLE |
| 51 | — | — | 700 | 47.1 | COMPARATIVE EXAMPLE |
| 52 | — | — | 700 | 27.2 | COMPARATIVE EXAMPLE |
| 53 | 432 | 65 | 720 | 11.2 | EXAMPLE |
| 54 | 432 | 65 | 720 | 11.2 | EXAMPLE |
| 55 | 432 | 65 | 720 | 12.1 | EXAMPLE |
| 56 | — | — | 720 | 25.7 | COMPARATIVE EXAMPLE |

TABLE 5

| No. | EXAMPLE STEEL | TEMPERATURE RAISED AT HOT ROLLING: SOLID-SOLUTION TEMPERATURE FOR BN (°C.) | SOLID-SOLUTION TEMPERATURE FOR AlN (°C.) | HEATING TEMPERATURE (°C.) | NORMALIZING CONDITION: MAINTAINING TEMPERATURE (°C.) | PERIOD MAINTAINED (h) |
|---|---|---|---|---|---|---|
| 57 | O | — | 1097 | 1100 | — | — |
| 58 | O | — | " | 1100 | — | — |
| 59 | O | — | " | 1150 | 865 | 1 |
| 60 | O | — | " | 1100 | — | — |
| 61 | O | — | " | 1200 | — | — |
| 62 | P | 1062 | 1040 | 1075 | — | — |
| 63 | P | " | " | 1089 | 878 | 1 |
| 64 | P | " | " | 1099 | — | — |
| 65 | P | " | " | 1065 | — | — |
| 66 | Q | 1039 | 838 | 1078 | — | — |
| 67 | Q | " | " | 1087 | 850 | 2 |
| 68 | R | 1106 | 1081 | 1125 | — | — |
| 69 | R | " | " | 1130 | 865 | 0.5 |
| 70 | R | " | " | 1116 | — | — |
| 71 | R | " | " | 1056 | — | — |
| 72 | S | — | 1031 | 1032 | — | — |
| 73 | T | — | 1016 | 1065 | — | — |
| 74 | U | — | 1004 | 1045 | — | — |

| No. | ANNEALING CONDITION: FIRST STAGE TEMPERATURE (°C.) | FIRST STAGE HOLDING TIME (min) | SECOND STAGE TEMPERATURE (°C.) | SECOND STAGE HOLDING TIME (h) | CLASSIFICATION |
|---|---|---|---|---|---|
| 57 | 456 | 68 | 710 | 87.5 | COMPARATIVE EXAMPLE |
| 58 | — | — | 710 | 88.6 | COMPARATIVE EXAMPLE |
| 59 | — | — | 710 | 86.1 | COMPARATIVE EXAMPLE |
| 60 | — | — | 698 | 87.1 | COMPARATIVE EXAMPLE |
| 61 | — | — | 688 | 99.8 | COMPARATIVE EXAMPLE |
| 62 | 450 | 50 | 715 | 47.4 | COMPARATIVE EXAMPLE |
| 63 | — | — | 715 | 47.4 | COMPARATIVE EXAMPLE |
| 64 | — | — | 705 | 72 | COMPARATIVE EXAMPLE |
| 65 | — | — | 690 | 60 | COMPARATIVE EXAMPLE |
| 66 | 450 | 25 | 700 | 20.7 | COMPARATIVE EXAMPLE |
| 67 | — | — | 700 | 20.7 | COMPARATIVE EXAMPLE |
| 68 | 560 | 25 | 685 | ‡ ‡ | COMPARATIVE EXAMPLE |
| 69 | — | — | 690 | ‡ ‡ | COMPARATIVE EXAMPLE |
| 70 | — | — | 690 | ‡ ‡ | COMPARATIVE EXAMPLE |
| 71 | — | — | 695 | ‡ ‡ | COMPARATIVE EXAMPLE |
| 72 | 500 | 65 | 695 | ‡ ‡ | CONVENTION EXAMPLE |
| 73 | 500 | 65 | 695 | ‡ ‡ | CONVENTION EXAMPLE |
| 74 | 500 | 65 | 695 | ‡ ‡ | CONVENTION EXAMPLE |

‡ ‡not be graphited

TABLE 6

| No. | EXAMPLE STEEL | GRAFITE STRUCTURE: GRAFITE PARTICLE SIZE (μm) | GRAFITE STRUCTURE: HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 1 | A | 5.0 | 151.2 | 43.1 | 761.6 | 69.6 | 639 | 872 | 25 | 51 | 316 | 494 | EXAMPLE |
| 2 | A | 27.4 | 151.2 | 40.1 | 761.6 | 58.9 | 505 | 812 | 13 | 38 | 280 | 398 | COMPARATIVE EXAMPLE |
| 3 | A | 5.0 | 151.2 | 43.1 | 761.6 | 69.6 | 654 | 872 | 27 | 54 | 318 | 510 | EXAMPLE |
| 4 | A | 26.4 | 151.2 | 40.2 | 761.6 | 59.4 | 517 | 821 | 16 | 38 | 280 | 390 | COMPARATIVE EXAMPLE |
| 5 | B | 9.6 | 158.7 | 48.0 | 757.0 | 67.2 | 725 | 897 | 22 | 47 | 325 | 520 | EXAMPLE |
| 6 | B | 8.9 | 158.7 | 50.2 | 757.0 | 65.3 | 726 | 895 | 20 | 45 | 318 | 516 | EXAMPLE |
| 7 | B | 26.4 | 158.7 | 44.1 | 757.0 | 59.2 | 610 | 846 | 16 | 32 | 280 | 398 | COMPARATIVE EXAMPLE |
| 8 | B | 9.6 | 158.7 | 48.0 | 757.0 | 67.2 | 725 | 906 | 23 | 48 | 330 | 528 | EXAMPLE |
| 9 | C | 12.2 | 162.3 | 50.7 | 760.4 | 65.8 | 768 | 985 | 18 | 45 | 339 | 542 | EXAMPLE |
| 10 | C | 29.8 | 162.3 | 43.5 | 760.4 | 57.4 | 647 | 954 | 12 | 32 | 304 | 436 | COMPARATIVE EXAMPLE |
| 11 | C | 27.8 | 162.3 | 45.2 | 760.4 | 58.4 | 649 | 953 | 13 | 34 | 309 | 430 | COMPARATIVE EXAMPLE |
| 12 | C | 27.9 | 162.3 | 44.3 | 760.4 | 58.3 | 639 | 942 | 11 | 35 | 310 | 425 | COMPARATIVE EXAMPLE |
| 13 | D | 15.1 | 174.9 | 53.2 | 753.8 | 64.3 | 815 | 1099 | 12 | 32 | 357 | 571 | EXAMPLE |
| 14 | D | 12.4 | 174.9 | 53.2 | 753.8 | 65.5 | 817 | 1010 | 13 | 32 | 369 | 590 | EXAMPLE |
| 15 | D | 13.2 | 174.9 | 55.0 | 753.8 | 63.7 | 850 | 980 | 14 | 30 | 364 | 586 | EXAMPLE |
| 16 | D | 34.8 | 174.9 | 48.6 | 753.8 | 54.9 | 732 | 908 | 8 | 23 | 322 | 443 | COMPARATIVE EXAMPLE |
| 17 | E | 14.2 | 186.9 | 56.7 | 749.4 | 64.5 | 880 | 997 | 11 | 29 | 362 | 579 | EXAMPLE |
| 18 | E | 28.5 | 186.9 | 47.3 | 749.4 | 57.6 | 807 | 909 | 8 | 23 | 348 | 452 | COMPARATIVE EXAMPLE |
| 19 | E | 27.9 | 186.9 | 46.2 | 749.4 | 57.9 | 806 | 910 | 9 | 23 | 348 | 438 | COMPARATIVE EXAMPLE |
| 20 | E | 27.9 | 186.9 | 45.2 | 749.4 | 57.9 | 804 | 912 | 9 | 23 | 348 | 442 | COMPARATIVE EXAMPLE |
| 21 | E | 14.3 | 186.9 | 56.7 | 749.4 | 64.4 | 890 | 999 | 11 | 29 | 362 | 579 | EXAMPLE |

TABLE 7

| No. | EXAMPLE STEEL | GRAFITE STRUCTURE: GRAFITE PARTICLE SIZE (μm) | GRAFITE STRUCTURE: HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 22 | F | 16.2 | 204.0 | 57.8 | 737.0 | 63.3 | 942 | 1125 | 19 | 31 | 369 | 590.4 | EXAMPLE |
| 23 | F | 15.2 | 204.0 | 57.8 | 737.0 | 63.8 | 952 | 1132 | 18 | 31 | 372 | 595 | EXAMPLE |
| 24 | F | 39.3 | 204.0 | 52.3 | 737.0 | 57.1 | 842 | 987 | 9 | 23 | 305 | 427 | COMPARATIVE EXAMPLE |
| 25 | F | 29.3 | 204.0 | 51.4 | 737.0 | 57.1 | 843 | 986 | 8 | 24 | 306 | 428 | COMPARATIVE EXAMPLE |
| 26 | G | 13.3 | 195.4 | 47.3 | 757.2 | 65.3 | 1150 | 1310 | 20 | 33 | 392 | 627 | EXAMPLE |
| 27 | G | 27.5 | 195.4 | 40.1 | 757.2 | 58.5 | 990 | 1240 | 8 | 22 | 384 | 499 | COM- |

TABLE 7-continued

| No. | EXAMPLE STEEL | GRAFITE STRUCTURE: GRAFITE PARTICLE SIZE (μm) | GRAFITE STRUCTURE: GRAFITE HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 28 | G | — | — | — | — | — | — | — | — | — | — | — | PARATIVE EXAMPLE COMPARATIVE EXAMPLE |
| 29 | G | 26.8 | 195.4 | 43.2 | 757.2 | 58.6 | 1005 | 1230 | 9 | 21 | 384 | 499 | COMPARATIVE EXAMPLE |
| 30 | H | 12.9 | 194.0 | 49.4 | 757.6 | 65.4 | 1160 | 1320 | 22 | 35 | 395 | 632 | EXAMPLE |
| 31 | H | 12.9 | 194.0 | 49.4 | 757.6 | 65.4 | 1170 | 1310 | 18 | 32 | 396 | 634 | EXAMPLE |
| 32 | H | 28.7 | 194.0 | 44.3 | 757.6 | 57.9 | 1010 | 1210 | 9 | 24 | 380 | 494 | COMPARATIVE EXAMPLE |
| 33 | H | 28.9 | 194.0 | 42.5 | 757.6 | 57.8 | 1005 | 1205 | 6 | 21 | 384 | 499 | COMPARATIVE EXAMPLE |
| 34 | I | 8.6 | 221.2 | 54.1 | 755.8 | 67.5 | 1200 | 1430 | 20 | 37 | 402 | 643 | EXAMPLE |
| 35 | I | 8.6 | 221.2 | 54.1 | 755.8 | 67.5 | 1195 | 1428 | 19 | 36 | 400 | 640 | EXAMPLE |
| 36 | I | 23.8 | 221.2 | 47.2 | 755.8 | 60.2 | 1100 | 1310 | 9 | 23 | 388 | 478 | COMPARATIVE EXAMPLE |
| 37 | I | 23.7 | 221.2 | 46.9 | 755.8 | 60.3 | 1115 | 1310 | 10 | 24 | 385 | 499 | COMPARATIVE EXAMPLE |
| 38 | J | 12.2 | 200.2 | 47.9 | 753.7 | 65.8 | 1230 | 1410 | 22 | 39 | 401 | 613 | EXAMPLE |
| 39 | J | 12.2 | 200.2 | 47.9 | 753.7 | 65.8 | 1210 | 1400 | 23 | 38 | 402 | 613 | EXAMPLE |
| 40 | J | 27.6 | 200.2 | 42.5 | 753.7 | 58.5 | 1070 | 1340 | 9 | 22 | 385 | 500 | COMPARATIVE EXAMPLE |
| 41 | J | 27.8 | 200.2 | 41.5 | 753.7 | 58.4 | 1015 | 1320 | 10 | 21 | 384 | 501 | COMPARATIVE EXAMPLE |

TABLE 8

| No. | EXAMPLE STEEL | GRAFITE STRUCTURE: GRAFITE PARTICLE SIZE (μm) | GRAFITE STRUCTURE: GRAFITE HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 42 | K | 3.2 | 152.9 | 95.2 | 758.4 | 70.1 | 1170 | 1340 | 20 | 36 | 395 | 672 | EXAMPLE |
| 43 | K | 2.6 | 152.9 | 95.2 | 758.4 | 70.4 | 1179 | 1350 | 21 | 35 | 396 | 673 | EXAMPLE |
| 44 | K | 24.6 | 152.9 | 87.2 | 758.4 | 59.9 | 1045 | 1270 | 10 | 23 | 388 | 504 | COMPARATIVE EXAMPLE |
| 45 | K | — | — | — | — | — | — | — | — | — | — | — | COMPARATIVE EXAMPLE |
| 46 | L | 11.4 | 293.3 | 41.9 | 765.3 | 66.2 | 1244 | 1450 | 15 | 34 | 413 | 661 | EXAMPLE |
| 47 | L | 11.4 | 293.3 | 41.9 | 765.3 | 66.2 | 1247 | 1460 | 15 | 30 | 414 | 661 | EXAMPLE |
| 48 | L | 30.2 | 293.3 | 32.3 | 765.3 | 57.2 | 1107 | 1330 | 7 | 22 | 397 | 516 | COMPARATIVE EXAMPLE |
| 49 | M | 11.4 | 233.5 | 46.0 | 769.7 | 66.2 | 1240 | 1440 | 12 | 29 | 426 | 681 | EXAMPLE |
| 50 | M | 11.4 | 233.5 | 46.0 | 769.7 | 66.2 | 1197 | 1443 | 13 | 26 | 427 | 682 | EXAMPLE |
| 51 | M | 35.2 | 233.5 | 40.0 | 769.7 | 54.8 | 1095 | 1310 | 7 | 14 | 387 | 503 | COM- |

TABLE 8-continued

| No. | EXAMPLE STEEL | GRAFITE STRUCTURE: GRAFITE PARTICLE SIZE (μm) | GRAFITE STRUCTURE: HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 52 | M | 35.3 | 233.5 | 39.1 | 769.7 | 54.8 | 1097 | 1314 | 8 | 15 | 388 | 504 | PARATIVE EXAMPLE COMPARATIVE EXAMPLE |
| 53 | N | 9.1 | 237.3 | 51.2 | 768.1 | 67.3 | 1230 | 1430 | 13 | 26 | 407 | 672 | EXAMPLE |
| 54 | N | 7.6 | 237.3 | 51.2 | 768.1 | 67.3 | 1228 | 1425 | 16 | 25 | 408 | 674 | EXAMPLE |
| 55 | N | 9.3 | 237.3 | 51.0 | 768.1 | 67.2 | 1238 | 1410 | 14 | 20 | 396 | 653 | EXAMPLE |
| 56 | N | 34.3 | 237.3 | 42.4 | 768.1 | 55.2 | 1090 | 1310 | 8 | 13 | 387 | 541 | COMPARATIVE EXAMPLE |

TABLE 9

| No. | EXAMPLE STEEL | GRAFITE STRUCTURE: GRAFITE PARTICLE SIZE (μm) | GRAFITE STRUCTURE: HARDNESS (Hv) | CUTTING CHARACTERISTIC: LIFE OF TOOL (min) | COLD FORGING CHARACTERISTIC: DEFORMATION RESISTANCE (MPa) | COLD FORGING CHARACTERISTIC: LIMIT COMPRESSION RATIO (%) | MECHANICAL CHARACTERISTICS AFTER HARDENING AND TEMPERING: YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 57 | O | 32.3 | 168.4 | 44.3 | 757.9 | 56.2 | 512 | 842 | 21 | 32 | 276 | 386 | COMPARATIVE EXAMPLE |
| 58 | O | 33.2 | 168.4 | 44.3 | 757.9 | 55.8 | 509 | 828 | 23 | 21 | 274 | 384 | COMPARATIVE EXAMPLE |
| 59 | O | 33.4 | 168.4 | 44.3 | 757.9 | 55.7 | 510 | 817 | 22 | 31 | 273 | 382 | COMPARATIVE EXAMPLE |
| 60 | O | 33.4 | 168.4 | 44.3 | 757.9 | 55.7 | 507 | 825 | 24 | 32 | 276 | 386 | COMPARATIVE EXAMPLE |
| 61 | O | 32.3 | 168.4 | 44.3 | 757.9 | 56.2 | 506 | 827 | 25 | 32 | 279 | 391 | COMPARATIVE EXAMPLE |
| 62 | P | 22.3 | 170.8 | 50.1 | 758.2 | 65.4 | 768 | 985 | 18 | 45 | 339 | 452 | COMPARATIVE EXAMPLE |
| 63 | P | 24.7 | 170.8 | 50.1 | 758.2 | 65.4 | 778 | 991 | 17 | 46 | 336 | 424 | COMPARATIVE EXAMPLE |
| 64 | P | 28.7 | 170.8 | 46.5 | 758.2 | 57.9 | 649 | 917 | 13 | 36 | 298 | 403 | COMPARATIVE EXAMPLE |
| 65 | P | 28.6 | 170.8 | 46.7 | 758.2 | 58.0 | 652 | 907 | 11 | 34 | 297 | 403 | COMPARATIVE EXAMPLE |
| 66 | Q | 27.8 | 170.9 | 48.9 | 757.2 | 65.1 | 511 | 841 | 23 | 32 | 278 | 389 | COMPARATIVE EXAMPLE |
| 67 | Q | 27.9 | 170.9 | 48.9 | 757.2 | 65.1 | 516 | 832 | 22 | 31 | 269 | 377 | COMPARATIVE EXAMPLE |
| 68 | R | — | — | — | — | — | — | — | — | — | — | — | COMPARATIVE EXAMPLE |
| 69 | R | — | — | — | — | — | — | — | — | — | — | — | COMPARATIVE EXAMPLE |
| 70 | R | — | — | — | — | — | — | — | — | — | — | — | COM- |

TABLE 9-continued

| No. | EXAMPLE STEEL | GRAFTIE STRUCTURE GRAFTIE PARTICLE SIZE (μm) | GRAFTIE STRUCTURE GRAFTIE HARDNESS (Hv) | CUTTING CHARACTERISTIC LIFE OF TOOL (min) | COLD FORGING CHARACTERISTIC DEFORMATION RESISTANCE (MPa) | COLD FORGING CHARACTERISTIC LIMIT COMPRESSION RATIO (%) | MECHANICAL CHARACTERISTICS AFTER HARDENING AND TEMPERING YS (MPa) | TS (MPa) | EI (%) | RA (%) | HARDNESS (Hv) | FATIGUE RESISTANCE (MPa) | CLASSIFICATION |
|---|---|---|---|---|---|---|---|---|---|---|---|---|---|
| 71 | R | — | — | — | — | — | — | — | — | — | — | — | PARATIVE EXAMPLE |
| 72 | S | — | 165.7 | 2.0 | 778.0 | 60.1 | 572 | 841 | 26 | 60 | 265 | 382 | COMPARATIVE EXAMPLE |
| 73 | T | — | 210.7 | 37.8 | 867.9 | 50.6 | 734 | 905 | 42 | 38 | 325 | 390 | CONVENTION EXAMPLE |
| 74 | U | — | 187.9 | 4.0 | 849.5 | 64.9 | 897 | 1026 | 24 | 52 | 324 | 480 | CONVENTION EXAMPLE |

What is claimed is:

1. A graphite steel for a machine structural use exhibiting excellent free cutting characteristic and cold forging characteristic for use in a hardened/tempered state consisting essentially of:

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %; and a balance consisting of Fe and unavoidable impurities, wherein substantially overall quantity of C is precipitated as graphite and size of the graphite is at most 20 μm.

2. A graphite steel for a machine structural use exhibiting excellent free cutting characteristic and cold forging characteristic for use in hardened/tempered state, consisting essentially of:

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %, and at least one of the substances selected from a group consisting of REM: 0.0005 wt % to 0.2 wt %;

Zr: 0.005 wt % to 0.:2 wt %;

Ti: 0.005 wt % to 0.05 wt %;

V: 0.05 wt % to 0.5 wt %

Nb: 0.005 wt % to 0.05 wt %;

Ni: 0.10 wt % to 3.0 wt %;

Cu: 0.1 wt % to 3.0 wt %;

Co: 0.1 wt % to 3.0 wt %;

Mo: 0.1 wt % to 1.0 wt %; and a balance consisting of Fe and unavoidable impurities, wherein substantially overall quantity of C is precipitated as graphite and size of the graphite is at most 20 μm.

3. The graphite steel of claim 1, wherein the fatigue strength is further increased after hardening and tempering the steel.

4. The graphite steel of claim 2, wherein the fatigue strength is further increased after hardening and tempering the steel.

5. A graphite steel consisting essentially of:

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %; and a balance consisting of Fe and unavoidable impurities, wherein substantially overall quantity of C is precipitated as graphite and size of the graphite is at most 20 μm so that after hardening and tempering, the steel is suitable for machine structural use due to its combination of fatigue resistance, cold forging characteristics, and free cutting characteristics.

6. A graphite steel consisting essentially of:

C: 0.1 wt % to 1.5 wt %;

Si: 0.5 wt % to 2.0 wt %;

Mn: 0.1 wt % to 2.0 wt %;

B: 0.0003 wt % to 0.0150 wt %;

Al: 0.005 wt % to 0.1 wt %;

O≦0.0030 wt %;

P≦0.020 wt %;

S≦0.035 wt %;

N: 0.0015 wt % to 0.0150 wt %, and at least one of the substances selected from a group consisting of REM: 0.0005 wt % to 0.2 wt %;

Zr: 0.005 wt % to 0.2 wt %;

Ti: 0.005 wt % to 0.05 wt %;

V: 0.05 wt % to 0.5 wt %

Nb: 0.005 wt % to 0.05 wt %;

Ni: 0.10 wt % to 3.0 wt %;

Cu: 0.1 wt % to 3.0 wt %;

Co: 0.1 wt % to 3.0 wt %;

Mo: 0.1 wt % to 1.0 wt %; and a balance consisting of Fe and unavoidable impurities, wherein substantially overall quantity of C is precipitated as graphite and size of the graphite is at most 20 μm so that after hardening and tempering the steel is suitable for machine structural use due to its combination of fatigue resistance, cold forging characteristics and free cutting characteristics.

7. A graphite steel according to claim 5, wherein said fatigue resistance is not less than 460 MPa.

8. A graphite steel according to claim 6, wherein said fatigue resistance is not less than 460 MPa.

* * * * *